US012156596B2

(12) United States Patent
Zadron

(10) Patent No.: US 12,156,596 B2
(45) Date of Patent: Dec. 3, 2024

(54) EXERCISE BENCH COVER AND METHOD OF USE

(71) Applicant: Roman Zadron, Vallejo, CA (US)

(72) Inventor: Roman Zadron, Vallejo, CA (US)

( * ) Notice: Subject to any disclaimer, the term of this patent is extended or adjusted under 35 U.S.C. 154(b) by 0 days.

(21) Appl. No.: 18/176,829

(22) Filed: Mar. 1, 2023

(65) Prior Publication Data

US 2023/0380602 A1 Nov. 30, 2023

Related U.S. Application Data

(60) Provisional application No. 63/345,173, filed on May 24, 2022.

(51) Int. Cl.
*A47C 31/10* (2006.01)
*A47C 15/00* (2006.01)

(52) U.S. Cl.
CPC ..... *A47C 31/10* (2013.01); *A47C 15/00* (2013.01)

(58) Field of Classification Search
CPC ..... A47C 31/10; A47C 15/00; A63B 21/4029
USPC ..... 297/224, 228.11
See application file for complete search history.

(56) References Cited

U.S. PATENT DOCUMENTS 4,132,228 A * 1/1979 Green ..... A47C 7/029 297/284.3
4,400,030 A 8/1983 Maruzzo
4,536,028 A 8/1985 Jones
4,553,785 A 11/1985 Duke, Jr.
4,884,839 A * 12/1989 Keiswetter ..... B60N 2/60 297/229
6,736,453 B2 5/2004 Chambers
2013/0088054 A1* 4/2013 Atchison ..... B60N 2/6027 297/228.11
2015/0313374 A1 11/2015 Johnson
2022/0312974 A1* 10/2022 Elkaim ..... A47C 7/622

FOREIGN PATENT DOCUMENTS

CN 210733466 U * 6/2020
EP 1407694 A1 * 4/2004 ..... A47C 31/113
JP H0231712 U * 2/1990

* cited by examiner

*Primary Examiner* — Milton Nelson, Jr.
(74) *Attorney, Agent, or Firm* — Brennan, Manna & Diamond, LLC

(57) ABSTRACT

The present invention relates to an exercise equipment bench or seat cover for use with conventional benches or seated equipment used in gyms and fitness centers. The cover is non-slippery and absorbs sweat, water, and other fluids, thereby preventing the benches and seats from causing contamination. The cover encloses a bench such the top surface of the bench is covered completely and an elastic band of the cover securely holds the cover around the bench. An individual performing an exercise lies down or touches the cover and not the bench or seat directly. The sweat is absorbed by the top sweat or moisture absorbing layer while the bench is protected by the bottom rubbery or plastic layer. The cover is machine washable and reusable and helps in reducing the spread of germs, viruses, and bacteria in public gym environments.

11 Claims, 6 Drawing Sheets

EXERCISE BENCH COVER AND METHOD OF USE

CROSS-REFERENCE TO RELATED APPLICATION

The present application claims priority to, and the benefit of, U.S. Provisional Application No. 63/345,173, which was filed on May 24, 2022, and is incorporated herein by reference in its entirety.

FIELD OF THE INVENTION

The present invention relates generally to the field of exercise accessories and personal safety equipment. More specifically, the present invention relates to a novel exercise equipment bench covering device for protecting cross-contamination among exercising users and reducing the spread of germs, viruses, and bacteria in public gym environments. The covering device has a very thin layer of sweat or moisture absorbing material layered atop a thin rubbery or plastic material (i.e., non-moisture absorbing material), wherein the two layers are sewn or adhered together. When the cover is used and a user performs exercises, the sweat is absorbed and the user does not directly touch the bench, thereby preventing contamination. Accordingly, the present disclosure makes specific reference thereto. Nonetheless, it is to be appreciated that aspects of the present invention are also equally applicable to other like applications, devices, and methods of manufacture.

BACKGROUND

By way of background, a lot of people like to exercise and work out for many reasons including. but not limited to, weight control, muscle building, health, stress relief, and plain old vanity. Working out at home may save money, but can be ineffective and regularly attending a fitness center or gym offers numerous advantages over home workouts. Fitness centers and gyms provide a wide variety of exercise equipment ranging from free weights, to resistance training machines, to cardio machines, and core stability equipment.

For people who exercise at gyms and fitness centers, cross-contamination of body fluids (i.e., sweat, viruses, and germs) is a concern. In gyms, larger areas of skin such as of the back, chest, legs and more come into contact with exercise equipment and may cause cross-contamination due to sweat. As a result, people are at risk for spreading germs, viruses, and bacteria through touch, sweating, and other means. Various research and studies have shown that Staph bacteria are found on the surface of every piece of exercise equipment in a gym. Other common skin infections including ringworm, plantar warts, or impetigo are commonly caused due to contamination in gyms and fitness centers.

For preventing cross-contamination, regular cleaning and disinfecting are performed using chemical sprays and disinfectors, however, such chemical sprays applied to the benches and equipment may be a health hazard once mixed with sweat and other debris. Many times, the benches may not be disinfected and can cause contamination. People may use their personal cloth to wipe a bench or other equipment before use, which may be cumbersome, ineffective, and time-consuming. Existing methods for disinfection and sanitization are useful for different touchpoints such as handles, lockers, and more but do not provide any effective mechanism for cleaning and disinfecting gym equipment. People desire a new and effective way to protect gym equipment from excessive contamination.

Therefore, there exists a long-felt need in the art for a device and method to prevent cross-contamination in gyms while using the equipment for exercising. There is also a long-felt need in the art to reduce the spread of germs, viruses, and bacteria in public gym environments. Additionally, there is a long-felt need in the art for a device that can cover a bench or any other equipment to prevent direct touch of skin of a user to a bench or other exercise equipment. Moreover, there is a long-felt need in the art for a device that prevents sweat, water, and other fluids from contaminating an exercise bench and its surrounding area. Finally, there is a long-felt need in the art for a simple device that obviates use of chemical sprays and/or disinfectants on exercise benches, and that also prevents health hazards for exercising people in public gyms and fitness centers.

The subject matter disclosed and claimed herein, in one embodiment thereof, comprises a gym equipment bench cover for reducing the spread of germs, viruses, bacteria, and more. The cover features a generally square or rectangular sheet having an outer surface and an inner surface, the sheet is folded along the peripheral region for forming an overlapping narrow flap portion and creating an opening, an elastic band looped along the peripheral edge for securing the cover around the bench, wherein the sheet encloses the bench such that inner surface touches the bench and an exercising user touches the outer or top surface, thereby preventing direct contact of the user with the bench while performing the exercise. The sheet has two layers for effectively absorbing sweat and providing a stable and non-slippery surface for exercising to a user.

In this manner, the gym equipment bench cover of the present invention accomplishes all of the forgoing objectives and provides users with a unique covering designed to protect gym equipment from excessive contamination. The cover securely holds onto gym equipment bench to absorb sweat of an exercising user and therefore, prevents sweat, water, and other fluids from contaminating the bench and its surrounding area. The cover eliminates use of disinfecting solution and other cleaning solutions in public gyms.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a reusable and washable covering for a gym equipment bench or other exercise device. The covering features a generally square or rectangular sheet having an outer surface and an inner surface, the sheet is folded along the peripheral region for forming an overlapping narrow flap portion and creating an opening, an elastic band looped along the peripheral edge, wherein the sheet encloses the bench such that inner surface touches the bench and an exercising user touches the outer or top surface, thereby preventing direct contact of the user with the bench while performing the exercise.

In a further embodiment of the present invention, a dual-layered cover device for covering an exercise bench is disclosed. The cover device is designed to cover the top surface of the exercise bench to reduce the spread of germs, viruses, and bacteria among exercising users. The cover device includes a top layer formed of a sweat or moisture absorbing and anti-microbial material and a bottom layer made of PVC rubber. The cover device features an elastic band along the periphery for securing the cover device and to fit same onto the bench such that the outer surface of the cover device touches the body of an exercising user and the inner surface of the cover device touches the bench surface when the cover device is deployed onto the bench.

In a further embodiment of the present invention, a method for performing an exercise using exercise equipment is disclosed. The method comprising the steps of providing an exercise bench cover, the cover is sized to fit and substantially enclose the exercise bench top, a top layer made of sweat or moisture absorbing material and a bottom layer made of non-slipping rubber or plastic material (i.e., non-moisture absorbing material), wherein the cover has an elastic band for holding the cover securely around the bench; stretching the cover to enclose the bench such that the top surface of the bench is covered by the cover; tightening the cover to fit the bench using a free end of the elastic band; and, performing the exercise such that the user performing the exercises touches the cover and not the bench, thereby preventing contamination of the bench.

In a further embodiment of the present invention, the cover is machine washable and reusable.

In a further embodiment of the present invention, one or more logos are printed or sewn on the bench cover.

In one embodiment, the cover is designed to enclose and cover a seat of exercise equipment/device.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
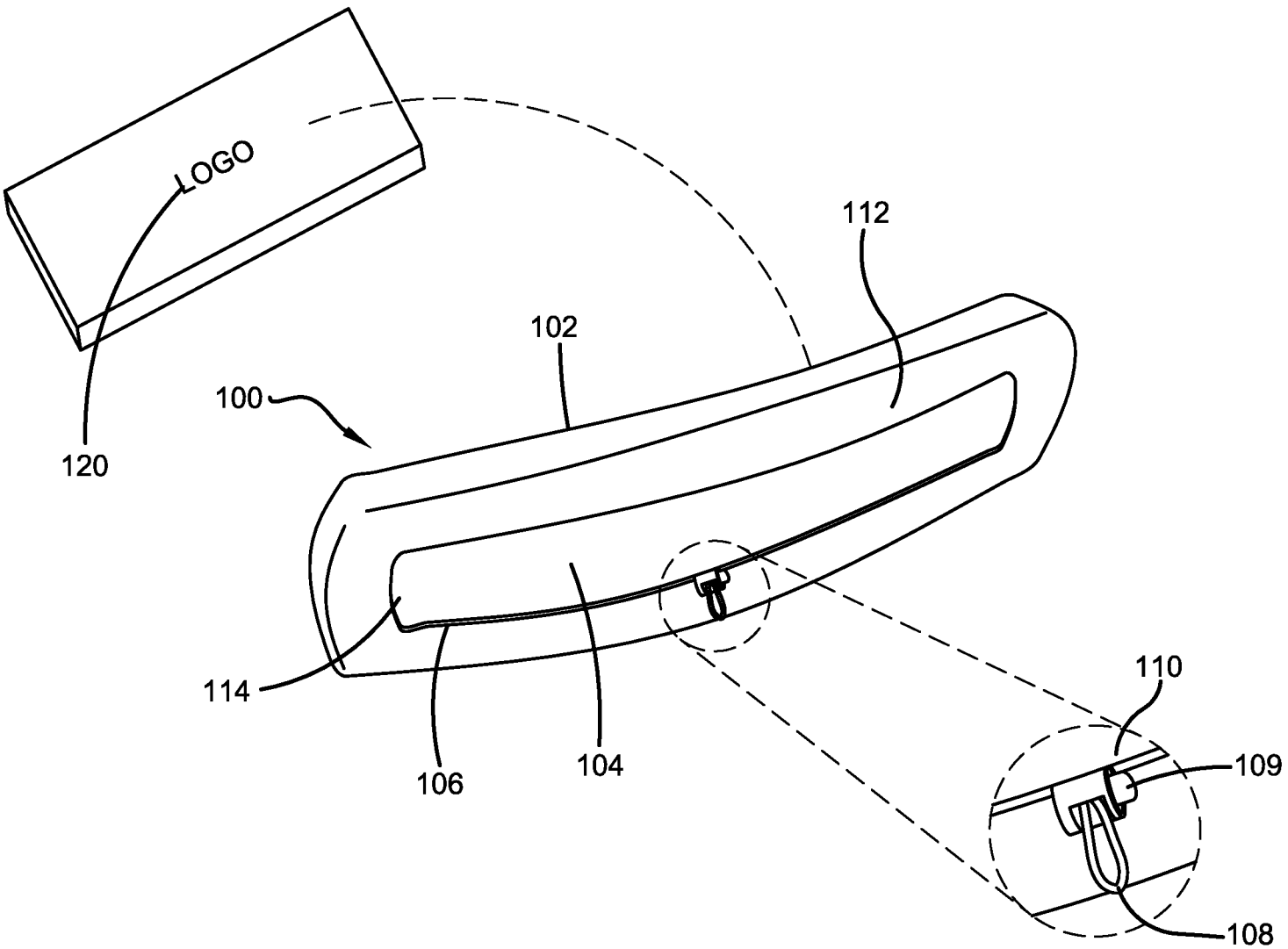
FIG. 1 illustrates a perspective view of one potential embodiment of a gym equipment bench cover of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device and method to prevent cross-contamination in gyms while using equipment for exercising. There is also a long-felt need in the art to reduce the spread of germs, viruses, and bacteria in public gym environments. Additionally, there is a long-felt need in the art for a device that can cover a bench or any other exercise equipment to prevent direct touch of the skin of a user onto a bench and/or seat. Moreover, there is a long-felt need in the art for a device that prevents sweat, water, and other fluids from contaminating an exercise bench and its surrounding area. Finally, there is a long-felt need in the art for a simple device that eliminates use of chemical sprays and disinfectants on exercise benches, and that also prevents health hazards for exercising people in public gyms and fitness centers.

The present invention, in one exemplary embodiment, is a dual-layered cover device for covering an exercise bench. The cover device is designed to fit to and over the top surface of the exercise bench for reducing the spread of germs, viruses, and bacteria among exercising users. The cover device includes a top layer formed of a sweat or moisture absorbing and anti-microbial material and a bottom layer made of PVC rubber. The cover device features an elastic band along the periphery for securing and fitting the cover device on the bench such that outer surface of the cover device touches the body of an exercising user and the inner surface of the cover device touches the bench surface when the cover device is deployed on the bench.

Referring initially to the drawings, FIG. 1 illustrates a perspective view of one potential embodiment of a gym equipment bench cover of the present invention in accordance with the disclosed architecture. The gym equipment bench cover 100 of the present invention is designed as a reusable and washable covering for a gym equipment bench to prevent cross-contamination. More specifically, the cover 100 has a one-piece construction and is generally rectangular or rectilinear having an exterior surface 102 and an interior surface 104. An elastic band 106 is positioned around the periphery of the cover 100 for enabling the cover 100 to be securely placed onto an exercise bench. The band 106 can be pulled using a free end 108 thereof for contracting the periphery of the cover 100 for securing around the bench. The band 106 is accommodated in a loop 110 positioned along the periphery of the cover 100, thereby providing an easy access of the band 106.

Figure 3:
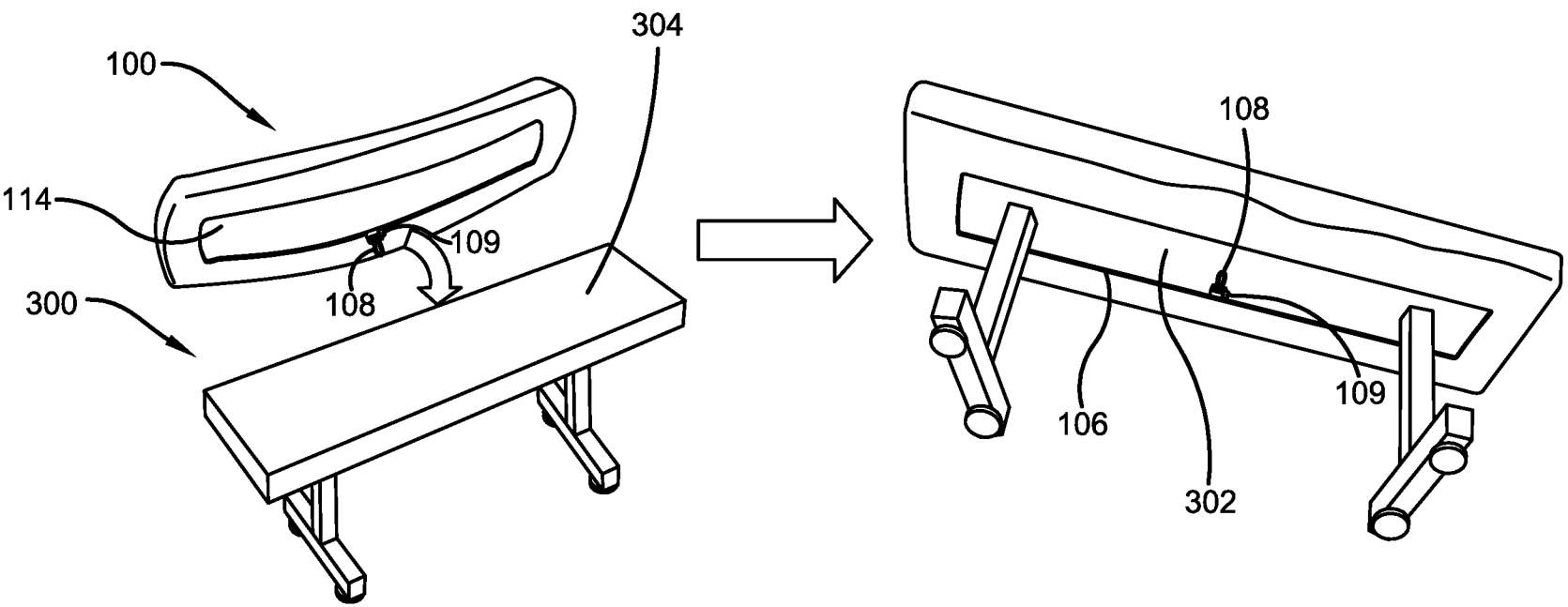
FIG. 3 illustrates a perspective view showing the workout bench cover of the present invention being positioned on an exercise bench to cover and substantially fit around the exercise bench in accordance with the disclosed architecture.
Figure 5:
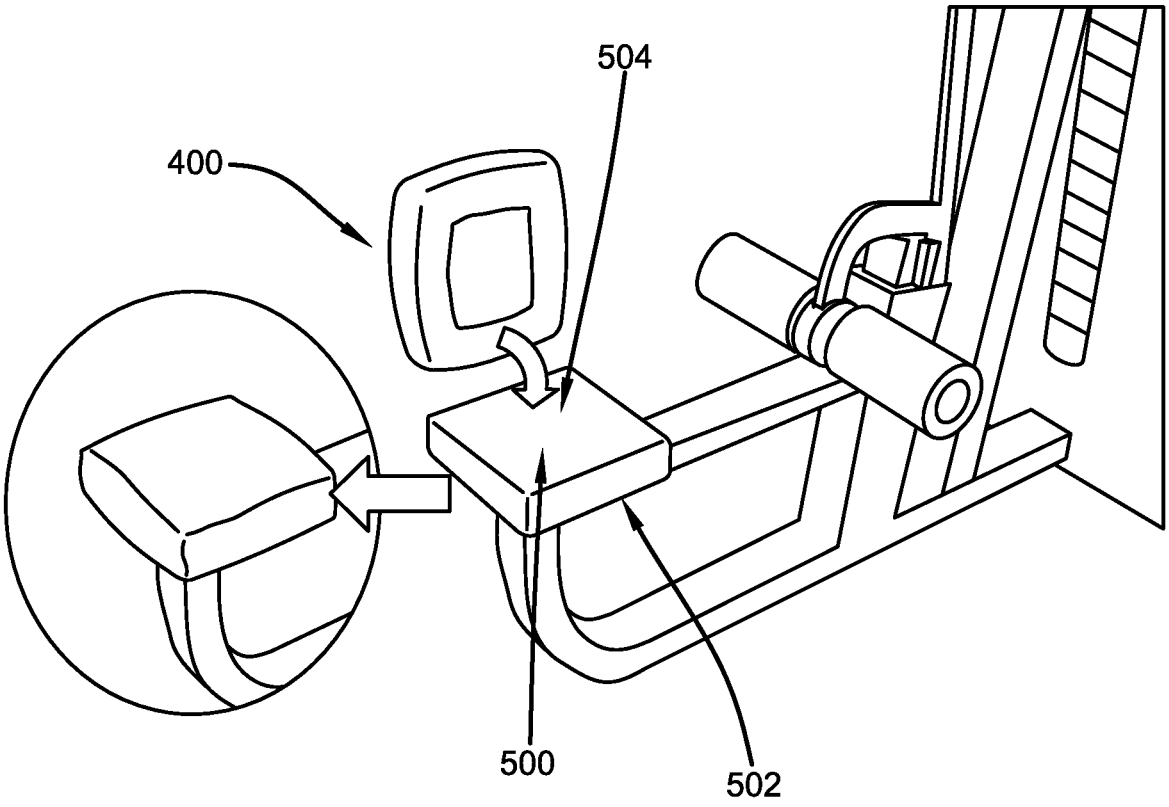
FIG. 5 illustrates a perspective view showing the exercise equipment seat cover of the present invention being positioned onto an exercise equipment seat in accordance with the disclosed architecture.

The cover 100 is dimensioned to fit to standard gym equipment benches/seats or exercise benches/seats to cover the top surface of such a bench/seat such that a user using the bench/seat for performing exercises lies or sits on the cover 100, contacts the exterior surface 102 and does not make direct contact with the bench or seat. The interior surface 104 touches the bench or seat when the cover 100 is secured to the bench or seat as illustrated in FIGS. 3 and 5. The cover 100 is designed to have a narrow flap, flange, or overhang portion 112 allowing the cover 100 to circumscribe, overlap, and secure to the bench or seat. The narrow flap or overhang 112 is formed by folding the peripheral portion and band 106 of the cover 100 over the sides and edges of the bench, and inwards thereunder, to form a rectangular opening 114 in the cover 100 that can be used for accommodating an exercise bench or seat surface as illustrated in FIG. 3. It is to be appreciated that opening 114 includes an area that is less than an area of the bench. The cover 100 is configured to removably secure to the bench or seat and provides support and uniform pressure to the back of an exercising user. The cover 100 may have one or more logos 120 for branding and marketing purposes and may comprise any insignia, badge, emblem, decoration, alphanumeric symbol, or artistic rendition that will adhere, either permanently or removably, to the cover 100. By way of example, and not limitation, the logos of the invention may include embroidered patches, stickers, transfers, paintings, and drawings.

Figure 2:
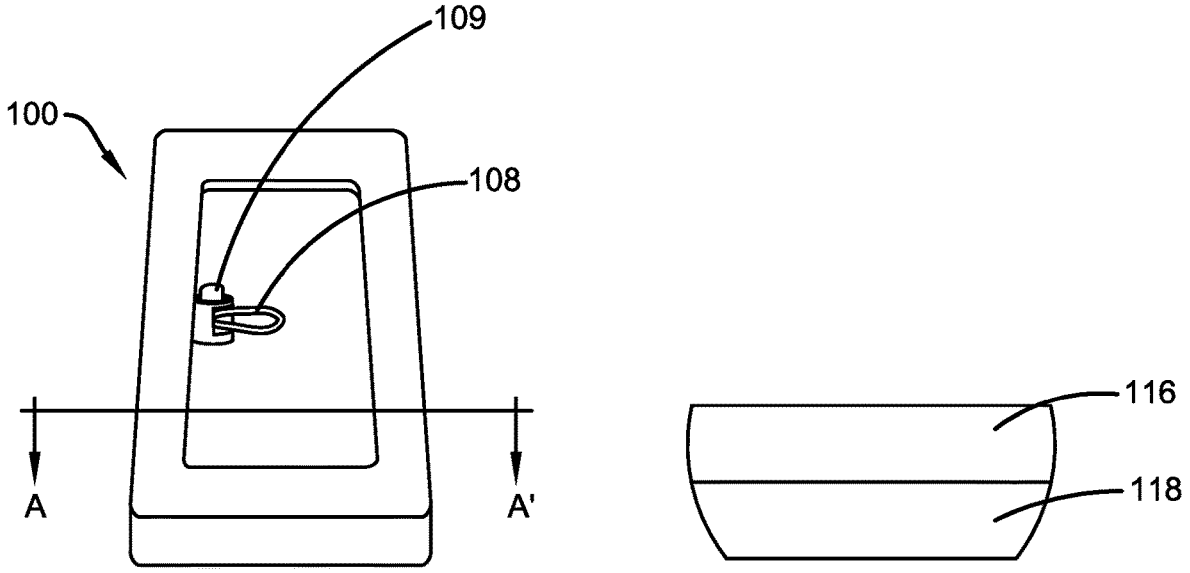
FIG. 2 illustrates a cross-sectional view of the exercise bench cover of the present invention in accordance with the disclosed architecture.

FIG. 2 illustrates a cross-sectional view of the exercise bench cover of the present invention in accordance with the disclosed architecture. As illustrated, the cover 100 has a layered structure and includes a top layer 116 and a bottom layer 118. The top layer 116 is substantially thin and is made from a sweat or moisture absorbing material selected from one or more of at least cotton, bamboo, linen, merino wool, polyester and more. The bottom layer 118 is made of non-slippery and non-toxic PVC rubber or plastic material (i.e., non-moisture absorbing material). The top layer 116 and the bottom layer 118 are sewn together or alternatively can be attached or adhered using an adhesive material.

In one exemplary embodiment, the top layer 116 has a thickness of about ¼" inches and the bottom layer 118 has a thickness of about ½" inches. The top layer 116 is configured to absorb sweat of an exercising user and the bottom layer 118 protects the bench on which the cover 100 is positioned from wear and tear and contamination. The top layer 116 also inhibits the growth of mildew, mold, and bacteria that can cause odors and spread germs. In some embodiments of the present invention, the top layer 116 may have Dendrimers as an anti-microbial material.

FIG. 3 illustrates a perspective view showing the workout bench cover of the present invention being positioned on an exercise bench to cover and fit the exercise bench in accordance with the disclosed architecture. The cover 100 comes in different designs and sizes to fit benches (or seats) in order to completely cover the top surface 304 of the bench 300. Depending on the requirements of the users, the band 106 can be pulled using the free end 108 being drawn through a spring retention clip 109 to tighten the cover 100 around the bench 300.

The cover 100 does not slip and provides optimal support to a user exercising on the bench 300 with the cover 100 covering the bench 300. In some embodiments, one proximal end of the cover 100 may have additional padding for supporting the shoulders of an exercising user. The cover 100 may come in different designs and colors to fit requirements and preferences of different users.

Figure 4:
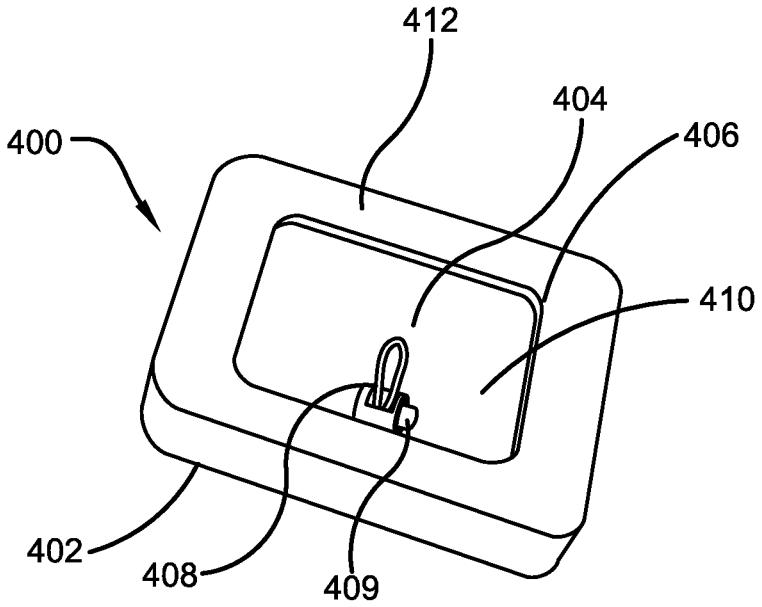
FIG. 4 illustrates a perspective view showing another embodiment of the exercise bench cover of the present invention in accordance with the disclosed architecture.

FIG. 4 illustrates a perspective view showing another embodiment of the exercise bench cover of the present invention in accordance with the disclosed architecture. In the present embodiment, the cover 400 is substantially rectilinear and can be used for covering seats of exercise equipment. The cover 400 has an exterior surface 402 and an interior surface 404. An elastic band 406 having a free end 408 drawn through a spring retention clip 409 is looped along the periphery such that the cover 400 using the square opening 410 formed by the square flap portion 412 accommodates a seat and fits to and over the seat. The cover 400 also has a layered structure as of the cover 100 shown in FIG. 2 and has a sweat or moisture absorbing top layer and a non-slipping plastic or rubber layer.

FIG. 5 illustrates a perspective view showing the exercise equipment seat cover of the present invention being positioned on an exercise equipment seat in accordance with the disclosed architecture. The cover 400 in an unfolded orientation is placed on the seat 500 such that the seat 500 is accommodated in the opening 410 and the flap portion 412 is positioned and adhered to the bottom surface 502 of the seat 500. The cover 400 is flexible and can be stretched when covering the seat 500. The elastic band 406 conforms the cover 400 to fit to and over the seat 500 while completely covering the top surface 504 of the seat 500. Depending on the requirements of the user, the band 406 can be pulled using the free end 408 to tighten the cover 400.

Figure 6:
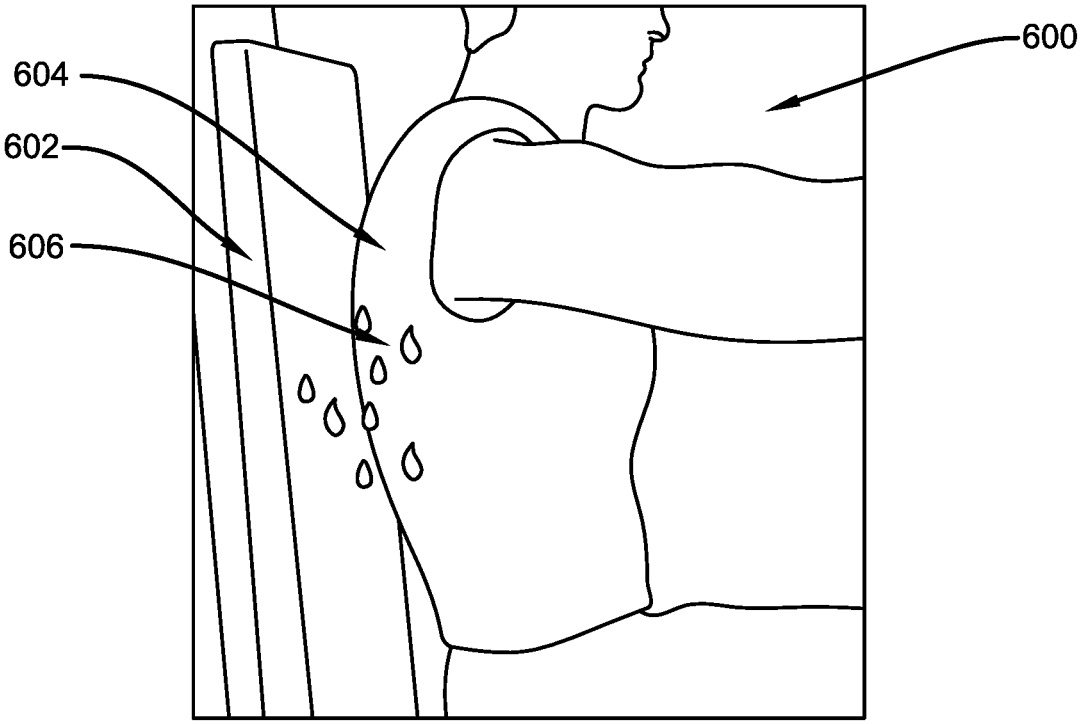
FIG. 6 illustrates a partial perspective view of a user using exercise equipment with the exercise equipment bench cover of the present invention deployed for preventing contamination in accordance with the disclosed architecture.

FIG. 6 illustrates a partial perspective view of a user using an exercise equipment with the exercise equipment bench cover 100 of the present invention deployed for preventing contamination in accordance with the disclosed architecture. The protective covers of different embodiments of the present invention are configured to prevent direct contact of skin of the user 600 with an exercise bench or seat 602. The cover 100 when deployed touches the body/skin 604 of the exercising user 600 and the top layer, as illustrated in FIG. 2, absorbs bacteria, sweat, water and other bodily fluids 606. The cover 100 secures to the bench 602, and thus provides stability and support to the user 600.

The covers of the present invention are reusable, machine-washable, breathable, and can be used for all types of exercise equipment used for yoga, aerobics, Pilates, and other exercises. The bench and seat covers are foldable and can be rolled for easy storage and transport.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "exercise bench cover", "workout bench cover", "exercise equipment bench cover", "exercise equipment seat cover", and "cover" are interchangeable and refer to the exercise equipment bench cover 100, 400 of the present invention.

Notwithstanding the forgoing, the exercise equipment bench cover 100, 400 of the present invention can be of any suitable size and configuration as is known in the art without affecting the overall concept of the invention, provided that it accomplishes the above-stated objectives. One of ordinary skill in the art will appreciate that the exercise equipment bench cover 100, 400 as shown in the FIGS. are for illustrative purposes only, and that many other sizes and shapes of the exercise equipment bench cover 100, 400 are well within the scope of the present disclosure. Although the dimensions of the exercise equipment bench cover 100, 400 are important design parameters for user convenience, the exercise equipment bench cover 100, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A gym equipment cover comprising:

a reusable cover having an outer surface, an inner surface, an elastic band around a periphery of said reusable cover, and a retention clip for retaining a contracted said elastic band;

wherein said elastic band is a loop for securing around a gym equipment;

wherein said elastic band having a free end for pulling said elastic band into said retention clip and contracting said periphery of said reusable cover for securing said periphery to the gym equipment;

wherein said outer surface having a top layer of moisture absorbent material;

wherein said inner surface having a bottom layer of non-moisture absorbing material;

wherein said top layer is adhered to said bottom layer;

wherein said reusable cover is generally rectilinear;

wherein the gym equipment is a bench and said reusable cover is a bench cover;

wherein said reusable cover having a flap portion for overlapping sides and edges of the bench and for securing under the bench;

wherein said periphery of said reusable cover forming an opening having a first area and the bench having a second larger area;

wherein said top layer having a thickness of about ¼" and said bottom layer having a thickness of about ½"; and wherein said bottom layer including a material consisting of a non-toxic PVC rubber and a plastic material.

2. The gym equipment cover of claim 1, wherein said top layer including an anti-microbial material having Dendrimers.

3. The gym equipment cover of claim 1, wherein said reusable cover is washable.

4. A gym equipment cover comprising:

a reusable cover having an outer surface, an inner surface, an elastic band around a periphery of said reusable cover, and a retention clip for retaining said elastic band;

wherein said elastic band is a loop for securing around a gym equipment;

wherein said elastic band having a free end for pulling said elastic band into said retention clip and contracting said periphery of said reusable cover for securing said periphery to the gym equipment;

wherein said outer surface having a top layer of moisture absorbent material;

wherein said top layer including a material selected from a group consisting of one or more of a cotton, a bamboo, a linen, a merino wool, and a polyester;

wherein said inner surface having a bottom layer of non-moisture absorbing material;

wherein said top layer is adhered to said bottom layer;

wherein said reusable cover is washable;

wherein said reusable cover having a flap portion for overlapping sides and edges of the gym equipment and for securing under the gym equipment;

wherein said periphery of said reusable cover forming an opening having a first area and the gym equipment having a second larger area; and wherein said bottom layer including a material consisting of a non-toxic PVC rubber and a plastic material.

5. The gym equipment cover of claim 4, wherein the gym equipment is a bench and said reusable cover is a bench cover.

6. The gym equipment cover of claim 4, wherein the gym equipment is a seat and said reusable cover is a seat cover.

7. The gym equipment cover of claim 4, wherein said top layer having a thickness of about ¼" and said bottom layer having a thickness of about ½".

8. The gym equipment cover of claim 4, wherein said top layer including an anti-microbial material having Dendrimers.

9. A gym equipment cover comprising:

a reusable cover having an outer surface, an inner surface, an elastic band around a periphery of said reusable cover, and a retention clip for retaining a contracted said elastic band;

wherein said elastic band is a loop for securing around a gym equipment;

wherein said elastic band having a free end for pulling said elastic band into said retention clip and contracting said periphery of said reusable cover for securing said periphery to the gym equipment;

wherein said outer surface having a top layer of moisture absorbent material;

wherein said top layer including a material selected from a group consisting of one or more of a cotton, a bamboo, a linen, a merino wool, and a polyester;

wherein said inner surface having a bottom layer of non-moisture absorbing material;

wherein said top layer is adhered to said bottom layer;

wherein said bottom layer including a material consisting of a non-toxic PVC rubber and a plastic material; and further wherein said top layer including an anti-microbial material having Dendrimers.

10. The gym equipment cover of claim 9, wherein the gym equipment is a bench and said reusable cover is a bench cover.

11. The gym equipment cover of claim 10, wherein said reusable cover having a flap portion for overlapping sides and edges of the bench and for securing under the bench.

* * * * *